United States Patent [19]

Nakamura

[11] 4,090,815

[45] May 23, 1978

[54] HIGH VACUUM PUMP

[75] Inventor: Kazuaki Nakamura, Kariya, Japan

[73] Assignee: Aisin Seiki Kabushiki Kaisha, Japan

[21] Appl. No.: 747,428

[22] Filed: Dec. 3, 1976

[30] Foreign Application Priority Data

Dec. 3, 1975 Japan ..... 50/144273

[51] Int. Cl.[2] ..... F04B 23/12; F04B 23/14; F01D 1/36; F03B 5/00

[52] U.S. Cl. ..... 417/203; 415/90; 417/205

[58] Field of Search ..... 415/90; 417/201, 203, 417/205

[56] References Cited

U.S. PATENT DOCUMENTS

| | | | |
|---|---|---|---|
| 2,954,157 | 9/1960 | Eckberg | 415/90 |
| 3,104,802 | 9/1963 | Eckberg | 417/205 X |
| 3,947,193 | 3/1976 | Maurile | 415/90 X |

*Primary Examiner*—Carlton R. Croyle
*Assistant Examiner*—R. E. Gluck
*Attorney, Agent, or Firm*—Oblon, Fisher, Spivak, McClelland & Maier

[57] ABSTRACT

A high-vacuum pump is disclosed as including a molecular pump assembly and an oil-seated rotary pump assembly, a speed change mechanism being interposed between the two assemblies so as to transmit driving forces, with a predetermined ratio, between the assemblies. The molecular pump assembly includes a housing having inlet and outlet ports, and spiral grooves, including main and subsidiary grooves, are provided upon interior wall surfaces of the housing so as to establish fluidic communication between the ports. A vacuum-sealed rotor, suitably mounted upon a first drive shaft, is rotatably disposed within the housing so as to achieve a compression and pumping operation of fluid along the spiral grooves from the inlet port to the outlet port, and the oil-sealed rotary pump assembly is likewise provided with inlet and outlet ports, the inlet port thereof being directly connected to the outlet port of the molecular pump assembly. A rotor, suitably mounted upon a second drive shaft, is likewise disposed within a chamber of the rotary pump in such a manner as to define therewith variable-volume chambers fluidically connected to the inlet and outlet ports thereof, and the speed-change mechanism mechanically connects the drive shafts of both pump assemblies.

8 Claims, 15 Drawing Figures

HIGH VACUUM PUMP

BACKGROUND OF THE INVENTION

1. Field of the Invention

This invention relates generally to high-vacuum pumps, and more particularly to a high-vacuum pump which can continuously achieve an exhaust or pumping operation over a wide vacuum range.

2. Description of the Prior Art

Conventionally, the oil-sealed rotary pump of the Gaede type has heretofore been utilized in which, as the rotor advances, the inhalation, compression, and exhaustion stages of air or other gas are cylically repeated so as to achieve the exhaust operation of the air. The above rotary pumps are well known in the art as being effective to obtain pressures of $10^{-4}$ Torr or less as ultimate pressures. In other words, the rotary pumps are most effective in the viscous flow region of air.

The molecular pump such as that of the Siegbahn type has also been proposed in which air or another gas is compressed and exhausted along grooves when a circular disk rotates inside a metal container consisting of two shields having the grooves. The molecular pump has been considered to have many advantages over diffusion pumps. Firstly, the time required to get the pumps into generation is less than that required for diffusion pumps. Secondly, such pumps pump all kinds of gases and vapors which means that no liquid-air traps or similar devices are required. Lastly, molecular pumps have the property of pumping heavy gases faster than light ones in contrast to diffusion pumps which behave in the opposite manner.

Therefore, it will be considered that in order to obtain a vacuum over a wide range extending from atmospheric to a high-vacuum of approximately to$^{-6}$ Torr, the oil-sealed rotary pumps which now function as backing pumps may be combined with the molecular pumps of the Siegbahn type which are effective in the molecular region of air.

However, in the molecular pumps of the Siegbahn type having grooves, a high compression ratio of $10^5$ or more is required because such pumps have been designed and intended to obtain an inlet vacuum pressure of a $10^{-6}$ or $10^{-7}$ Torr level under forepressure of a $10^{-1}$ or $10^{-2}$ Torr level. Therefore, the depth of the grooves should be considerably shallow in view of the mean free path of the molecular exhausted air and the depth thereof near the outlet of the pumps will usually be one millimeter. This results in the fact that the continuous pump operation under 0.5 or 10 Torr produces a considerably high amount of heat, and this disadvantage is apt to occur wherein the disk is brought into contact with the shields due to a thermal expansion thereof.

In the above construction, if the outlet of the molecular pump of the groove type is connected in series to the inlet of the rotary pump so as to achieve a two-stage, successive pumping function from atmospheric to a high-vacuum level, the molecular pump acts as the exhaust resistance against the rotary pump when in the viscous flow region of air, so that the speed of the exhaust of the rotary pump is decreased.

In addition to the above requirement relating to the high compression ratio, the clearances between the sides of the circular disk and the shields have to be several hundredths of a millimeter in order to maintain the fore pressure, and spiral grooves must be cut in the shields, the same being deep at the periphery and gradually decreasing in depth towards the center. Due to the aforenoted small clearances, it is possible that foreign objects may be trapped in the clearances, and the disk may encroach upon the shields because of a partial thermal expansion.

In addition, in the molecular pumps of the groove type, the speed of the exhaust is in proportion to the cross-sectional areas of the grooves and the velocity of the disk. However, it is quite difficult to design grooves of increasing depth or to increase the number of the grooves, due to the aforenoted requirement of a high compression ratio.

Another disadvantage of prior art molecular pumps of the spiral or screw groove type is that the bearings for the drive shaft are situated in the region of the fore-vacuum, and the vacuum seal mechanism, such as the packings for the drive shaft, are also situated in the region of the fore-vacuum. This means that lubricants for the bearings are subjected to vacuum pressure which results in a decrease of the durability of the bearings and the seal mechanisms, and in an increase in vacuum leakage, especially when there is high rotation of the drive shaft. In other words, it is substantially impossible to maintain a fore-vacuum of $10^{-2}$ Torr or more when there is high rotation of the shaft, such as, for example, at 6,000 R.P.M., or more.

The aforenoted varius requirements and drawbacks result in the impracticability of molecular pumps. It has been theoretically considered to design a high vacuum pump mechanism wherein the fluid in the viscous flow region is firstly pumped out to the fluid in the molecular flow region by means of the rotary pump assembly, and thereafter, the fluid in the molecular flow region is pumped out so as to obtain a high-vacuum level by means of the molecular pump assembly. However, this mechanism still does not achieve a sufficient pumping operation due to the aforenoted drawbacks of molecular pumps. In addition, the aforenoted mechanism requires two different driving means for each pump assembly and a by-pass passage means, for the rotary pump assembly, which is controlled by a change-over valve. These requirements result in a large-sized exhaust system and in great complexity in manipulating the apparatus.

SUMMARY OF THE INVENTION

Therefore, it is an object of the present invention to provide an improved high-vacuum pump mechanism which obviates the various aforementioned drawbacks.

It is another object of the present invention to provide an improved high-vacuum pump mechanism which continuously achieves an exhaust or pumping operation, by a single driving means, over a wide vacuum range from atmospheric to high-vacuum levels.

Still another object of the present invention is to provide an improved high-vacuum pump mechanism wherein a rotary pump assembly and a molecular pump assembly of the groove type are arranged in series, both pump assemblies being operated by a single driving means.

Yet another object of the present invention is to provide an improved high-vacuum pump mechanism comprising rotary and molecular pump assemblies wherein the compression ratio of the molecular pump assembly of the groove type may be rendered so that the heat, especially that portion produced between the disk and the housing, will be reduced, and the exhaust resistance against the rotary pump assembly will also be reduced.

A further object of the present invention is to provide an improved high-vacuum pump mechanism wherein the clearance between the sides of the disk and the shields of the molecular pump assembly may be large.

A still further object of the present invention is to provide an improved high-vacuum mechanism which satisfies high speed exhaust requirements.

A still yet further object of the present invention is to provide an improved high-vacuum pump mechanism which can maintain a high forepressure for the molecular pump assembly.

Yet still another object of the present invention is to provide an improved high-vacuum pump mechanism which can obtain clean high-vacuum conditions.

An additional object of the present invention is to provide an improved high-vacuum pump mechanism which is simple in construction.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE ILLUSTRATED EMBODIMENTS

Figure 1:
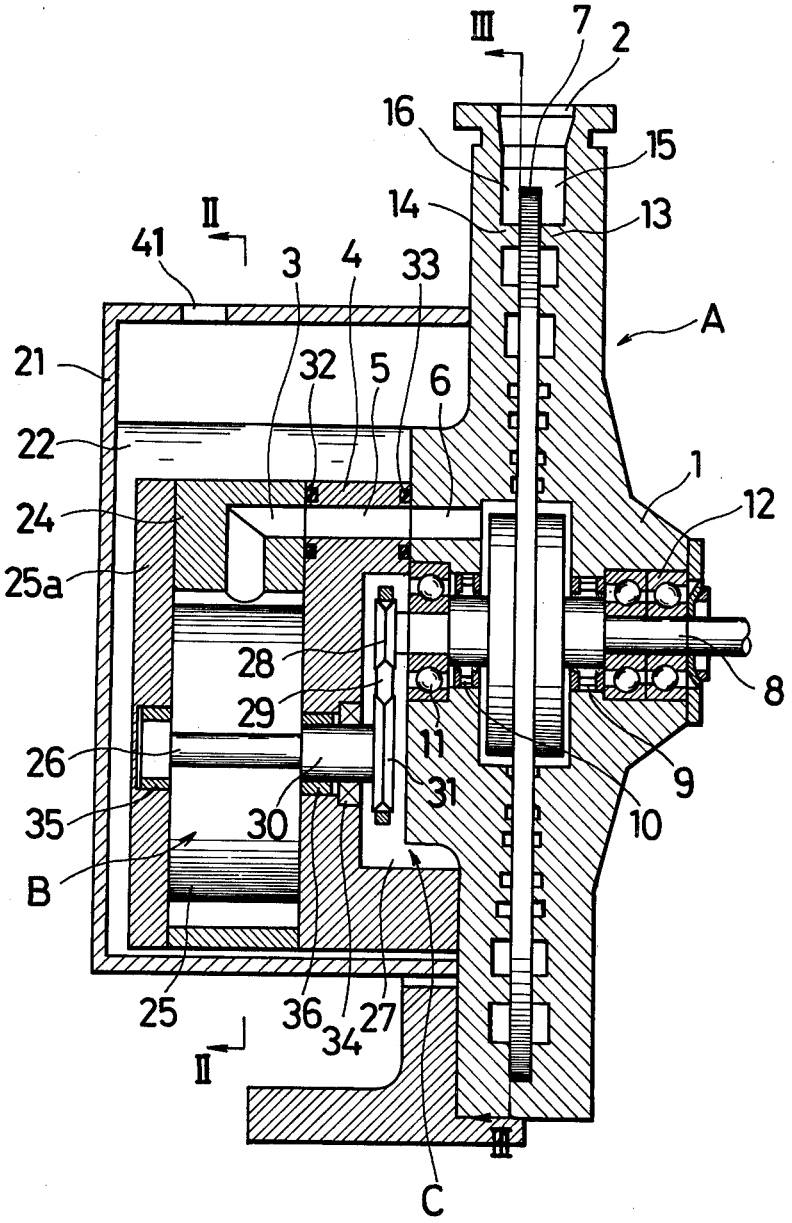
FIG. 1 is a cross-sectional view of one embodiment of a high-vacuum pump mechanism constructed according to the present invention.
Figure 2:
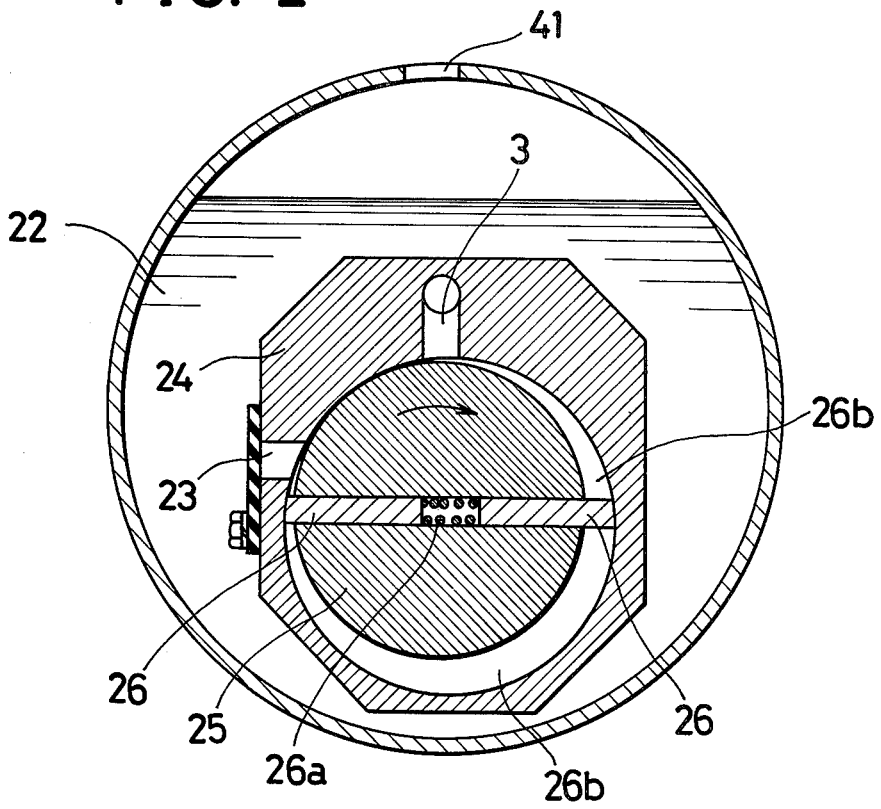
FIG. 2 is a cross-sectional view of the pump of FIG. 1 taken along the line II—II of FIG. 1.

Referring now to the drawings and more particularly to FIGS. 1 to 4*a* and 4*b* wherein a first embodiment of the present invention is illustrated, a high-vacuum pump mechanism comprises a molecular pump assembly A of the Siegbahn type and an oil-sealed rotary pump assembly B of the Gaede type.

The molecular pump A includes a housing or shield 1 having an inlet port 2 and an outlet port 6, the inlet port 2 being connected to an exhaust system, not shown, and the outlet port 6 being connected to an inlet port 3 of the rotary pump B, which acts as a backing pump, through means of a passage 5 formed in an intermediate housing 4. A circular disk 7 is arranged inside the housing 1 and is mounted upon a drive shaft 8 so as to be rotated thereby, it being apparent that the drive shaft 8 is driven by a suitable driving means, such as a motor, not shown. High-vacuum seals, such as two magnetic fluids 9 and 10 are arranged between the housing 1 and the shaft 8 so as to seal the area therebetween, the detailed explanation of such magnetic fluids being disclosed in U.S. Pat. No. 3,740,060. The drive shaft 8 is rotatably supported through means of annular ball bearing members 11 and 12 disposed within the housing 1 and about shaft 8 so as to maintain the same in the proper position, with respect thereto, the ball bearings being disposed upon the atmospheric side of the magnetic fluids 9 and 10 so as not to be subjected to any vacuum pressure.

The clearances between the side surfaces of disk 7 and the inner walls 13 and 14 of housing 1 are several tenths of a millimeter, and formed within the walls 13 and 14 are spiral grooves 15 and 16, the cross-sectional areas of which are gradually decreased from the inlet portion 2 towards the outlet portion 6.

As a result of the aforementioned construction of the molecular pump A, a conventional exhaust operation of the Siegbahn pump can be achieved wherein air or other gas, in the molecular flow region, is able to be pumped out to the outlet port 6 through means of the spiral grooves 15 and 16 as the disk 7 rotates. In addition, it is also noted that each spiral groove has a subsidiary groove **16*b*, which may be of the labyrinth seal type, subdivided from a main groove 16*a***, as shown in FIGS. 3 and 4*a* and 4*b*, wherein only the groove 16 is illustrated, the subsidiary groove **16*b* having only one end which is open to the outlet port 6, the other end thereof being closed by means of a wall 20, of housing 1, which partially defines main groove 16*a***, whereby the number of grooves is increased.

More particularly, the groove 16 has a peripheral portion 17 which connects with the inlet port 2 and an intermediate portion 19 disposed radially interiorly of the peripheral portion 17 by means of a predetermined distance. The intermediate portion 19 is defined by means of a dividing wall 18 of housing 1 and the subsidiary groove **16*b* is in turn defined within wall 18, the dividing ratio of both grooves 16*a* and 16*b* being theoretically determined in accordance with the compression ratio of air or other gas which passes through the groove 16. Namely, if the compression ratio between the peripheral portion 17*a* and the intermediate portion 19 is 2, the cross-sectional area of the main groove 16*a* may be one-half, or more, that of groove 16 at the peripheral portion 17. It will be clear that both walls 14 and 18** have the same height.

Figure 4A:
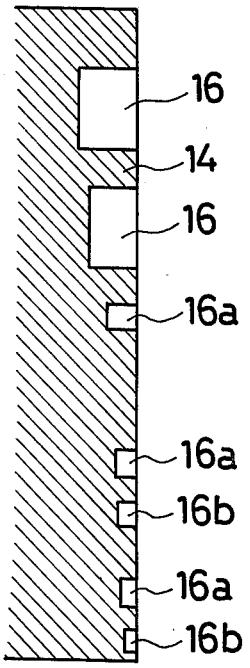
FIGS. 4*a* and 4*b* are cross-sectional views of the structure of FIG. 3 taken along the lines IV*a*–IV*a* and IV*b*–IV*b* of FIG. 3, respectively.
Figure 4B:
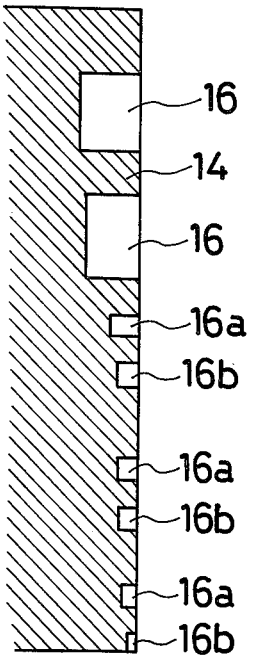
Figure 3:
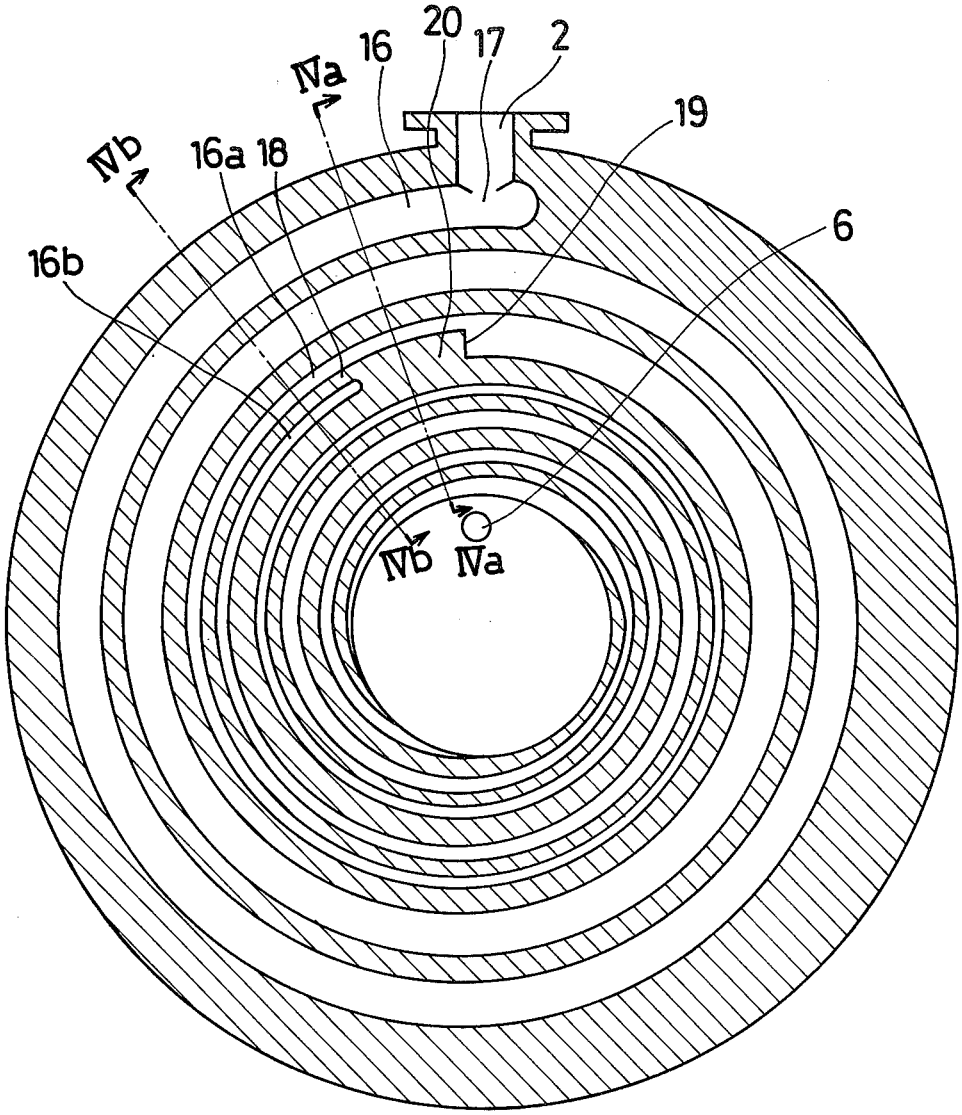
FIG. 3 is a cross-sectional view of the pump of FIG. 1 taken along the line III—III of FIG. 1.

Although FIGS. 3, 4*a* and 4*b* show only one subsidiary groove **16*b*, further subsidiary grooves may be provided, and it will also be apparent that the groove 15** likewise has main and subsidiary grooves.

An oil case 21 is secured to housing 1 of the molecular pump A so as to thereby provide an oil reservoir 22 therein, and the oil-sealed rotary pump B is arranged within reservoir 22 and includes a body 24 with a cover 25*a* which is also secured to housing 1, body 24 having defined therein the inlet port 3 and an outlet port 23 which is under atmospheric pressure as its backing pressure. Disposed within the annular bore of the body 24 is an eccentric rotor 25 having two rotational and slidable vanes 26 which are urged radially outwardly by means of a spring 26*a* interposed between the two vanes 26 so that variable volume chambers 26*b* are defined with body 24. As the rotor 25 rotates in the clockwise direction, as designated by the arrow in FIG. 2, the exhausted fluid at the inlet port 3 is sucked into one chamber 26*b* which is now connected to the inlet port 3 with a small gap between the rotor 25 and the bore of the body 24, while the exhausted fluid within the other chamber 26*b* is gradually compressed and pumped out to outlet port 23.

The intermediate housing 4 which is interposed between pump assemblies A and B has an interior space 27 within which is disposed a speed change mechanism C which comprises a first pulley 28 mounted upon the drive shaft 8 of molecular pump A and a second pulley 31 mounted upon a drive shaft 30 of rotary pump B, the drive shaft 30 being integrally formed with rotor 25. Both pulleys 28 and 29 are operatively connected by means of a belt 29 so that when the drive shaft 8 is driven, the drive shaft 30 is also driven by means of the speed change mechanism C. It is well known that the rotational speed of molecular pump A is higher than that of rotary pump B, and consequently, the speed change mechanism C is adapted to function as a reduction mechanism.

O-rings 32 and 33 are provided upon the outer portion of housing 4 for a vacuum sealing operation, and another seal member 34 is provided upon the central portion of housing 4 for sealing the drive shaft 30. The drive shaft 30 is rotatably disposed within cover 25*a* and the intermediate housing 4 by means of bearings 35 and 36, and the oil case 21 is seen to have an atmospheric discharging port 41.

As will be clear in accordance with the foregoing, the above-mentioned embodiment illustrates the one-stage oil-sealed rotary pump assembly B of the Gaede type as a rotary pump assembly in the low vacuum region, however it will be apparent that a two-stage rotary pump assembly of the Gaede type can also be arranged.

Because the number of grooves of the Siegbahn molecular pump assembly A is increased and one of the grooves has a labyrinth seal effect, the compression ratio of molecular pump assembly A may be reduced. The compression ratio may be further reduced because of the arrangement of the magnetic fluids, the leakage quantity of which is quite low. This allows for the considerably large clearance between the sides of the disk 7 and the inner walls 13 and 14 having the spiral grooves 15 and 16 so that the heat produced thereat, and the exhaust resistance against the rotary pump assembly B, will be reduced.

In operation, wherein air or other gas, conducted from the exhaust system to the molecular pump assembly A, is in the molecular flow region, that is, the mean free path of air or other gas is larger than the minimum depth of grooves 15 and 16, fluid which is sucked from the exhaust system into the inlet port 2 is compressed and pumped out by means of passing from the outer peripheries of grooves 15 and 16 towards the centers thereof when the disk 7 of molecular pump A is rotated at a high rate of speed, by means of the drive shaft 8, in the same direction as that in which grooves 15 and 16 extend.

During the above operation, it is recognized that the conventional oil-sealed rotary pump B of the Gaede type has an unavoidable fault wherein a part of the oil of the rotary pump flows backwards toward the outlet port 6 through means of the inlet port 3 and passage 5. According to the construction of the present invention in which both pump assemblies A and B are arranged in series and operated by the single driving means, however, even if oil flows backwards into grooves 15 and 16, the high rotational speed of disk 7 prevents the same from flowing backwards into the exhaust system. Namely, the oil which flows backwards into grooves 15 and 16 is compressed and pumped out into inlet port 3 along with the inhaled fluid from the exhaust fluid. The backward flowing oil mainly consists of hydrocarbon compounds, the number of carbon components of which is 4 or more, so that the molecular weight of the oil is heavier than that of air or water. Therefore, the exhaust operation will nevertheless be effective in view of the property of the molecular pump A of the Siegbahn type in which a high compression ratio is generated as the molecular weight increases. As a result, a clean vacuum fluid, which is free from hydrocarbons, will be obtained.

While the drive shaft 30 of oil-sealed rotary pump assembly B is driven through means of the speed change mechanism C when the drive shaft 8 is driven by a suitable driving means, as the speed change mechanism C acts as a reduction mechanism, the rotational speed of the shaft 30 is reduced to the extent that the rotary pump assembly B of the Gaede type is reliably operable within a low vacuum region.

Accordingly, the rotor 25 is rotated in the clockwise direction and the fluid which is pumped out to outlet 6 by molecular pump A is inhaled into one of the chambers 26*b* through means of passage 5 and inlet port 3, and thereafter, the inhaled fluid is compressed and successively pumped out to atmospheric conditions, through means of the outlet port 23, as the rotor 25 roates.

It should be noted that the leakage quantity of magnetic fluids 9 and 10 for sealing the vacuum conditions is $10^{-8}$ std cc/sec (He) or less, and it should also be noted that bearings 11 and 12 for the drive shaft 8 are arranged upon the atmospheric pressure sides of the magnetic fluids 9 and 10 so that the vacuum degree is not reduced due to the presence of, for example, lubricants. Therefore, vacuum which is substantially the same as the ultimate pressure of the rotary pump can be maintained at the outlet port 6 of molecular pump A, or in other words, vacuum of the $10^{-1}$ Torr level, in the case of the conventional one-stage rotary pump B of the Gaede type, or vacuum of the $10^{-3}$ Torr level, in the case of a two-stage rotary pump B of the Gaede type, can be easily maintained.

The operation of both pump assemblies will now be explained in more detail according to experiments and theory. In the molecular pump A of the Siegbahn type, in the high vacuum region, it is well known that the rotary motion of the disk 7 is imparted to the molecules of the fluid which collide with the disk 7 so that the fluid is exhausted along the spiral grooves 15 and 16. If the leakage through clearance between the walls 13 and 14 of the housing 1 and the disk 7 is neglected from consideration, the maximum compression rate ($r_o$) and the maximum speed (So) of the exhaust gases are expressed as follows:

$$r_o = \exp(\theta/h\,L\,u) \quad \ldots \quad (1)$$

$$S_o = bhu/2 \quad \ldots \quad (2)$$

wherein $b$ is the width of the groove, $h$ is the depth of the groove, L is the length of the groove, U is the angular velocity of the disk, and $\theta$ is the frictional constant of the fluid.

However, there is in fact the above-noted clearance, so that the backward flow of the fluid, due to leakage and diffusion thereof, may occur from the high pressure region to the low pressure region due to the quantity and difference in pressures of the fluid which can be exhausted along the grooves. Thus, the maximum compression ratio ($r_{max}$) can be achieved when the quantities of the backward flow and the exhaust flow are equal to each other. According to Gaede's or Tacolis' theory, the quantity of the exhaust flow will be in inverse proportion to the quantity of the backward flow, or in other words, as the quantity of the fluid is compressed along the grooves, the leakage and diffusion of the fluid from the high pressure region to the low pressure region may be increased.

The present invention considers the above characteristics of molecular pump A of the Siegbahn type and develops an improved molecular pump which obtains vacuum levels of $10^{-3} \sim 10^{-6}$ Torr with a compression ratio of approximately $10^2 \sim 10^3$.

If the diameter of disk 7 is designed to be 31 cm, the maximum peripheral velocity of disk 7 is to be $100^m$/sec, the depth and width of the peripheral portion of each groove is 1.2 cm, and the clearance between walls 13 and 14 and disk 7 is 0.15 mm, then a compression ratio of 50 or more, for air, can be obtained. In addition to the above conditions, if the spiral grooves are designed so as to include main and subsidiary grooves, as shown in FIG. 3, the compression ratio for air may be 100 or more. Namely, the maximum compression ratio may become large by the provision of such subsidiary grooves in comparison to the provision of a single groove.

The leakage quantity of the magnetic fluids for the vacuum sealing condition has been affirmed to be $10^{-8}$ std cc/sec (He) or less under an operational velocity of the drive shaft of 8,000 r.p.m. according to leakage experiments, using a helium soak detector, performed by the inventors. Therefore, the vacuum level of $10^{-3} \sim 10^{-4}$ can be maintained at the outlet port of the Siegbahn molecular pump A.

Furthermore, the heating value due to the compression work of the pumps should also be considered. The fluid, having an inlet pressure $P_1$ at the inlet port 2, is compressed and pumped out to the outlet port 6 as the discharge fluid, of pressure $P_2$, along the grooves when the disk 7 rotates. The heating value at this time corresponds to the compression work W in which the inlet pressure $P_1$ is changed to the value $P_2$ as the discharge pressure by the welding compression, and therefore, the heating value may be expressed as follows:

$$W = \frac{K}{K-1} P_1 V_1 \left[ \left( \frac{P_2}{P_1} \right)^{\frac{K-1}{K}} - 1 \right] \quad (3)$$

wherein K is the ratio of the specific heat and $V_1$ is the volume of the fluid at the inlet port.

According to the foregoing construction of the present invention, the compression ratio may be $10^2 \sim 10^3$ and the backing pressure, of $10^{-3}$ Torr or more, may be maintained near the outlet port. This means that the depth and cross-sectional area of each groove can be designed to be larger than that of the conventional one. In other words, the groove can be designed such that the compression work is commenced under a high vacuum or $10^{-3}$ Torr level. As a result, the compression work W is considerably less because the input pressure $P_1$ is $10^{-3}$ Torr or less, whereby the heating value is considerably less. This prevents the destruction of the pump assembly due to heat, so that the two-stage operating pump assembly will be practicable wherein the outlet port 6 of the Siegbahn molecular pump A is connected to the inlet port 3 of the Gaede rotary pump A and both pumps are operated by means of the single driving means so as to obtain the continuous exhaust operation from atmospheric to high-vacuum conditions.

In summary, it is practicable to design the Siegbahn molecular pump A having a compression ratio of 100 or more under a high backing pressure of $10^{-3}$ Torr or more. For instance, the ultimate pressure of the two-stage operating pump of the present invention will be on the $10^{-5}$ Torr level when the inlet pressure of the rotary pump assembly B is on the $10^{-3}$ Torr level and the compression ratio of the molecular pump assembly A is 100, on the assumption that no leakage, or the like, is considered.

As mentioned hereinabove, if the molecular weight of the exhausted fluid is heavier than that of air, the molecular pump assembly A has a comparatively high compression ratio. Thus, the backward flow of oil from the Gaede rotary pump assembly B can be effectively exhausted so as to thereby maintain clean vacuum conditions.

The foregoing equation (2) shows the speed of the exhaust of the Siegbahn molecular pump A. The practical exhaust speed within the vacuum region of $10^{-3} \sim 10^{-5}$ Torr can easily be designed. Namely, the exhaust speed which corresponds to the quantity of exhaust of 3,000 - 6,000 l/min. can be practically and easily designed when $b$, $h$, L and $u$ in the above equations (1) and (2) are properly designed.

The exhaust characteristics of the Gaede rotary pump B will now be considered hereinafter. Because the quality and the quantity of the exhausted fluid at the inlet port 2 will be equal to that of fluid at the outlet port 6, the following equation can be written:

$$\frac{P_2}{P_1} = \frac{V_1}{V_2} \quad (4)$$

wherein $V_2$ is the volume of fluid at the outlet port 6. $P_2/P_1$ is normally designed to be 100 or more in the molecular flow region so that $V_1/V_2$ will be 100 or more. This means that V2 is considerably less than that of V1. If $P_2/P_1 = 100$, then V2 becomes V1/100, and therefore, the speed of the exhaust of the Gaede rotary pump B will be effective when V2 is one hundredth or more. Namely, the speed of the exhaust of the Siegbahn molecular pump A which corresponds to 1,000 - 6,000 l/min. can be practicable in the vacuum region of $10^{-3} \sim 10^{-5}$ Torr, and therefore, the speed of the exhaust of the Gaede rotary pump B may have a value which corresponds to 10 – 60 l/min. when $P_2/P_1$ is 100. These requirements are quite practicable.

The operation of the present invention will now be explained wherein the fluid flow to the molecular pump assembly A is in the viscous flow region, that is, the mean free path of air or other gas is considerably less than the minimum depth of grooves 15 and 16.

It is well known that in the viscous flow region of fluids, the Siegbahn molecular pump assembly A achieves no function of compression and exhaust even when the disk 7 mounted upon the drive shaft 8 is rotated at a high rate of speed by means of a suitable driving means. The Siegbahn molecular pump assembly A serves only as a passage for the fluid to the Gaede pump assembly B because the outlet port 6 is connected to the inlet port 3. The drive shaft 30 of the Gaede rotary pump B is driven through means of the speed change driven through means of the speed change mechanism C acting as a reduction mechanism, as mentioned hereinabove, and this actuates the Gaede rotary pump assembly B into operation so that the exhausted fluid at the outlet port 6 of the Siegbahn molecular pump A is inhaled into the inlet port 3 of the Gaede rotary pump B. The inhaled fluid is successively compressed and pumped out to atmospheric conditions through means of the outlet 23 as the rotor 25 rotates within the bore of the body 24.

Assuming that the revolution of disk 7 of the Spiegbahn molecular pump A stops, the following equation can be written:

$$\frac{1}{S_1} = \frac{1}{C_1} + \frac{1}{S_2} \tag{5}$$

wherein $S_1$ is the effective speed of the exhaust at the inlet port 2 of the Siegbahn molecular pump A, $C_1$ is the conductance in the Siegbahn molecular pump A, and $S_2$ is the speed of the exhaust at the inlet port 3 of the Gaede rotary pump B. The above equation (5) means that $S_1$ is less than $S_2$.

However, it should be noted that the disk 7 of the Siegbahn molecular pump A rotates at a high rate of speed during the operation of the Gaede rotary pump B, and therefore, a boost effect to $S_2$ between the sides of the disk 7 and grooves 15 and 16 will be derived from a proper design of the cross-sectional areas of grooves 15 and 16. According to the construction of the present invention as mentioned hereinabove, wherein the depth and cross-sectional area of each groove will be designed to be considerably large, the grooves 15 and 16 may impart high conductance values to the Gaede rotary pump B. Furthermore, it will be noted that the above conductance may be higher than that of conventional values because the clearances between the sides of the disk 7 and the walls 13 and 14 is designed to be several tenths of a millimeter.

The above construction will serve to clarify that the speed $S_2$ of the exhaust of the Gaede pump B can be designed without any difficulty from the standpoint of the exhaust resistance of the grooves which now serve only as a passage for the fluid wherein no compression work is achieved by the Siegbahn molecular pump A. Therefore, the heating value will be zero, as will be apparent from the above equation (3), and there are no difficulties due to heat.

Figure 7:
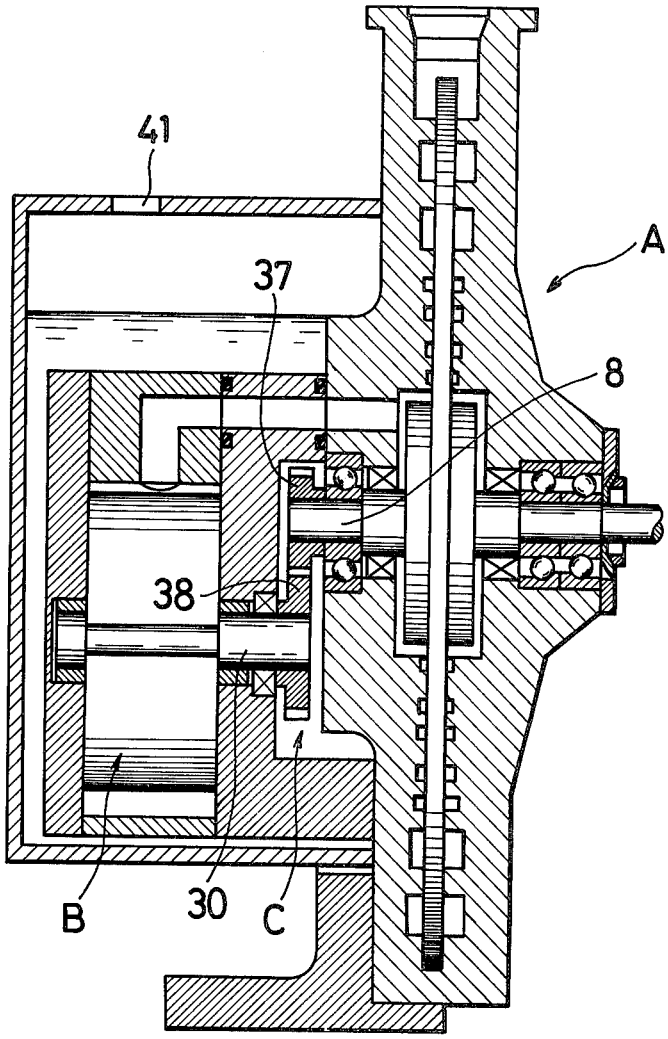
FIG. 7 is a view similar to that of FIG. 1, but illustrating still another embodiment of the present invention.

Turning now to FIG. 7, a modification of the speed change mechanism is illustrated. The drive shaft 8 of the Siegbahn molecular pump assembly A has a first gear 37 secured thereon, and the drive shaft 30 of the Gaede rotary pump assembly B likewise has a second gear 38 secured thereon. Both gears 37 and 38 are arranged to be enmeshed with each other so as to thereby constitute a speed change assembly. Other parts of this modification are the same as those of the previous embodiment, and the operation of the high vacuum pump assembly in FIG. 7 will be easily understood; consequently, a detailed explanation thereof is omitted herefrom.

Figure 5:
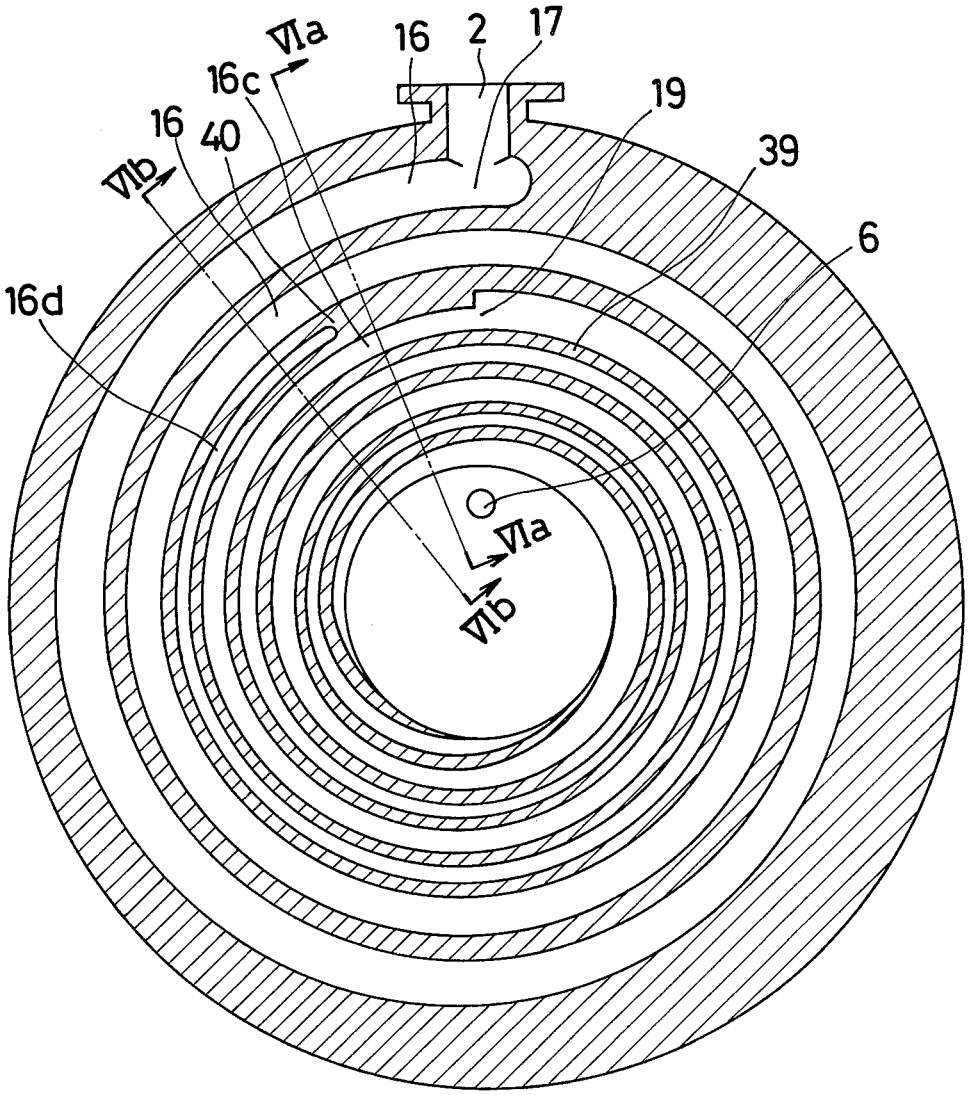
FIG. 5 is a view similar to that of FIG. 3, but illustrating another embodiment of the present invention.
Figure 6A:
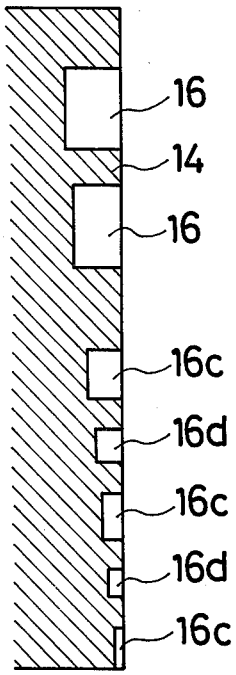
FIGS. 6*a* and 6*b* are cross-sectional views of the apparatus of FIG. 5 taken along the lines VI*a*–VI*a* and VI*b*–VI*b* of FIG. 5, respectively.
Figure 6B:
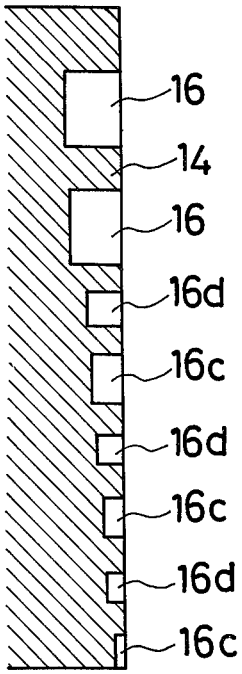
Figure 9:
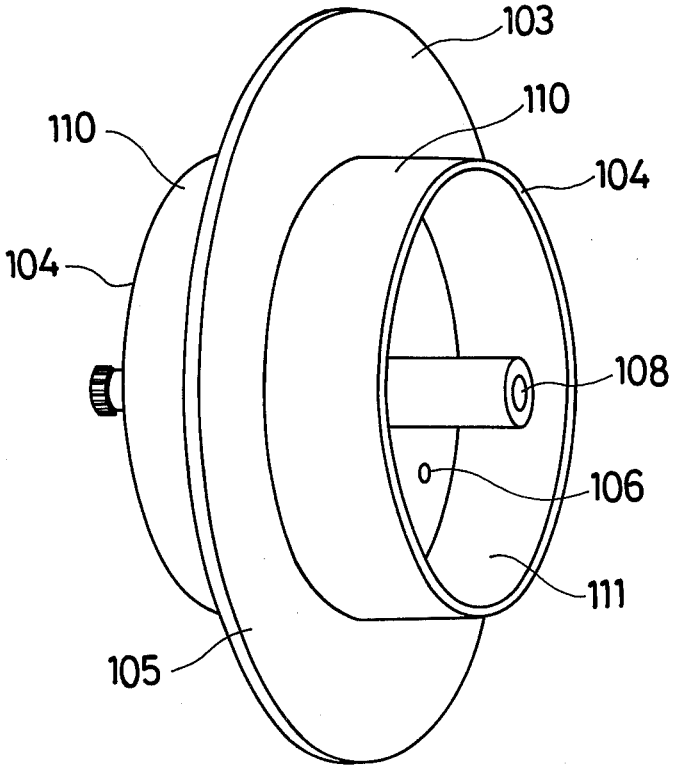
FIG. 9 is an enlarged perspective view of the circular disk of FIG. 8.

FIGS. 5 and 6 illustrate a modification of the grooves provided within the housing of the Siegbahn molecular pump assembly A wherein the same parts are designated by the same reference numerals of the previous embodiment.

Each groove, only one 16 of which is shown in FIG. 5, has the peripheral portion 17 disposed near the inlet port 2 and the intermediate portion 19 disposed away from the peripheral portion 17 by means of a predetermined radial distance. The width of the groove 16 is reduced at the intermediate portion 19 so as to thereby provide a main spiral groove **16*c* extending from the intermediate portion 19 toward the outlet port 6, the inner portion of the main groove 16*c* being on the same radial level as that of an inner wall 39 of the groove 16. The cross sectional areas of groove 16 and 16*c* become smaller as one proceeds from the inlet port 2 towards the outlet port 6, and the width of the main groove 16*c* extending from the intermediate portion 19** is designed in accordance with the compression ratio of the fluid.

A subsidiary groove **16*d* is also formed within the housing 1 between the groove 16 and the main groove 16*c*, and the end of groove 16*d* near the intermediate portion 19 is closed by means of a wall 40 which serves to define grooves 16 and 16*c*, while the other end thereof is open to outlet port 6. The cross-sectional area of the subsidiary groove 16*d*** may be smaller as one proceeds from the closed end toward the other open end, and it will be clearly understood that further grooves may be provided.

Referring now to FIGS. 8 – 11, a further modification of the present invention is illustrated wherein the same parts are designated by the same reference numerals as in the previous embodiment.

A molecular pump assembly D includes a housing 1 having two sections **1*a* and 1*b* secured to each other by means of a bolt 101 so as to thereby define a vacuum exhaust chamber 102 therebetween. A circular disk 103 comprises a cylindrical portion 104 and a radial flange 105 and has an aperture 106 which opens onto both sides of the disk 103. A drive shaft 107, which is keyed to the disk 103, is provided with a cooling blind hole 108 within which a jet nozzle 109 for cooling water is disposed. The inner part of the hole 108 extends to within the vicinity of the magnetic fluid 10, and the outer and inner surfaces 110 and 111 of the cylindrical portion 104** may be coated with a fluoride resin.

The disk 103 is adapted to be arranged with the clearances of 3–5 tenths of a millimeter between the sides of the disk 103 and the inner walls 112 and 113, the walls 112 and 113 having spiral grooves 114 and 115, respectively, provided therein which are arranged in a face-to-face relationship with respect to each other. The depths of grooves 114 and 115 are gradually reduced towards the radial central extents thereof, and the grooves 114 and 115 are designed to be in communication with intermediate exhaust chambers 116 and 117, respectively, which are formed within the walls 112 and 113 near the cylindrical portion 104.

Figure 10:
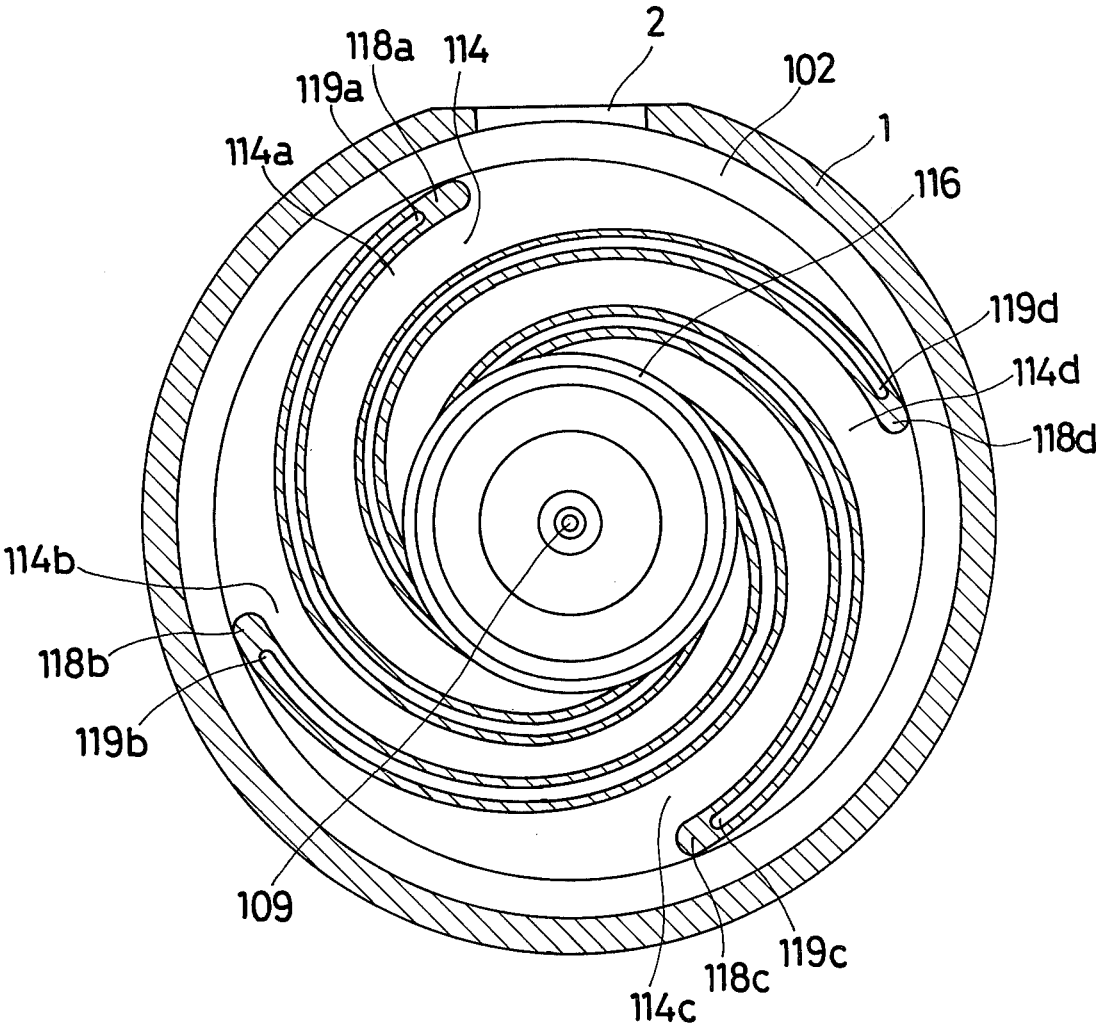
FIG. 10 is a cross-sectional view of the apparatus of FIG. 8 taken along the lines X—X of FIG. 8.

It should be noted that each groove comprises four grooves between the vacuum exhaust chamber 102 and the intermediate exhaust chambers 116 and 117, although only four grooves 114*a*, 114*b*, 114*c* and 114*d* relating to the groove 114 are shown in FIG. 10. Dividing walls 118*a*, 118*b*, 118*c* and 118*d* which define the four grooves 114*a*–114*d* thereby have four spiral grooves 119*a*, 119*b*, 119*c* and 119*d* of the labyrinth seal type, respectively, defined therein, one end of each labyrinth groove being closed but the other end thereof being open to the intermediate exhaust chamber 116. In addition, it will be clearly understood that further grooves may be formed or provided. Although each labyrinth groove is of a triangular configuration in cross section, the labyrinth groove may have a ractangular, sawtooth, or trapezoidal shape in cross-section.

The housing sections 1*a* and 1*b* have ring-shaped bores 120 and 121, respectively, provided therein, within which the cylindrical portion 104 of the disk 103 is disposed, the outer and innter surfaces 110 and 111 of the cylindrical portion 104 being designed to be arranged with clearances of 0.5 – 1 millimeter with respect to the outer and inner portions 122 and 123, and 124 and 125, of the bores 120 and 121. The outer portions 122 and 123 have screw groove means 126 and 127 and the inner portions 124 and 125 have screw groove means 128 and 129, the screw grooves 126 and 127 being designed to extend in opposite directions from the chambers 116 and 117 and towards additional exhaust chambers 130 and 131 which establish fluidic communication between the grooves 126 and 128, and between the grooves 127 and 129, respectively, while the screw grooves 128 and 129 are designed to extend in opposite directions from the chambers 130 and 131 and towards an annular forepressure chamber 132 which is in fluidic communication with the outlet port 6.

Therefore, it will be clearly understood that upon rotation of the cylindrical portion 104 of the disk 103, fluids in the molecular flow region within the chambers 116 and 117 are exhausted to the chambers 130 and 131 along the grooves 126 and 127, and then the fluids are exhausted from the chambers 130 and 131 to the chamber 132 along the grooves 128 and 129. According to the construction in FIG. 8, it will also be noted that each screw groove means may have a plurality of grooves. In addition, the depth of the screw grooves 126 and 127 may be considerably shallow towards the intermediate chambers 130 and 131, respectively, while the depths of screw grooves 128 and 129 may likewise be shallow towards the forepressure chamber 132, although the depths of all the grooves are shown to be constant in FIG. 8.

Figure 8:
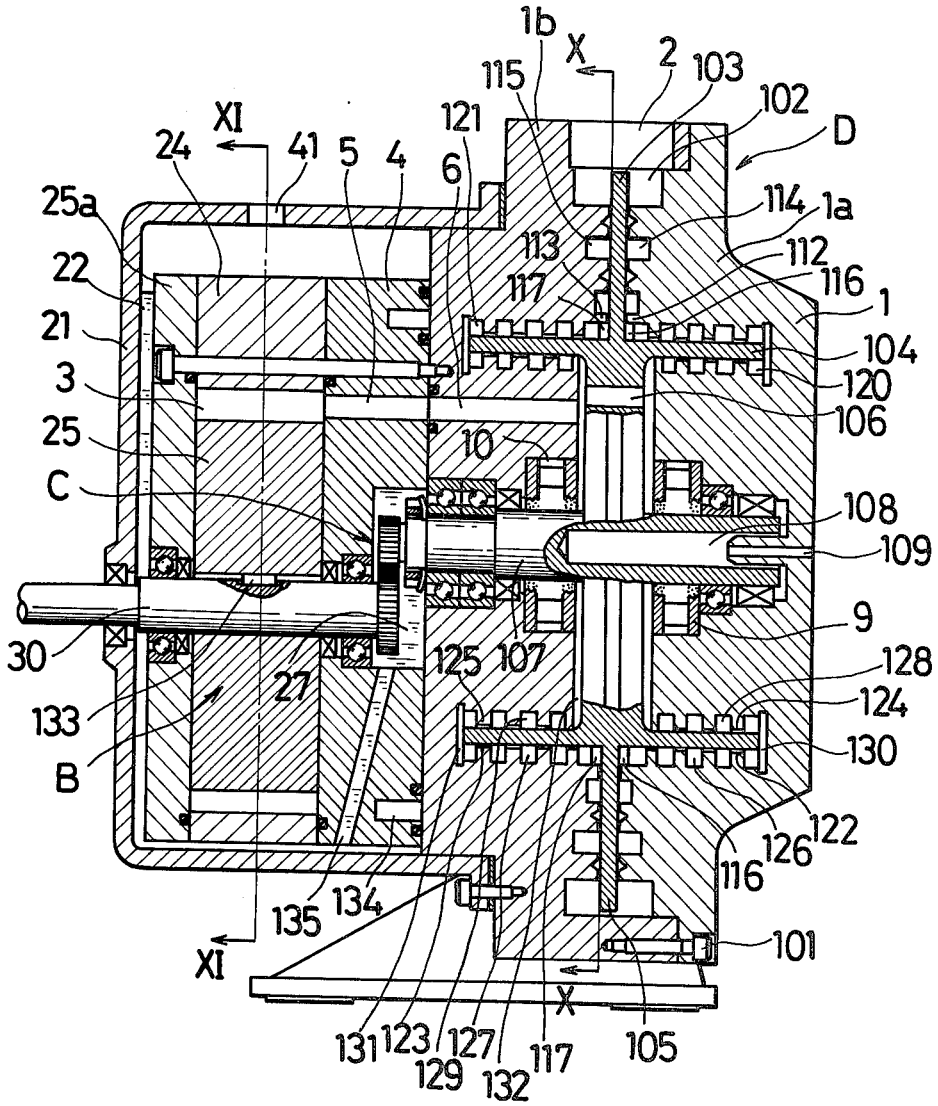
FIG. 8 is a view similar to that of FIG. 1, but illustrating a further embodiment of the present invention.
Figure 11:
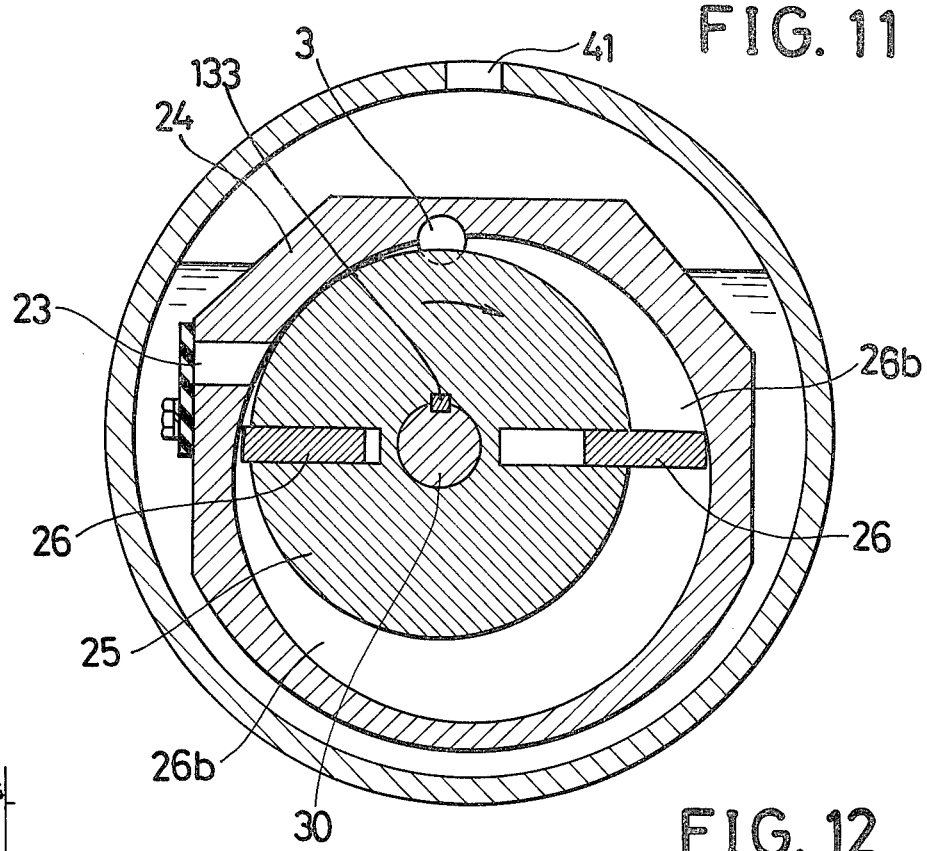
FIG. 11 is a cross-sectional view of the apparatus of FIG. 8 taken along the lines XI—XI of FIG. 8.

The construction of the rotary pump assembly B of the Gaede vane type will be substantially the same as that of the previous embodiment, FIGS. 8 and 11 particularly illustrating that the drive shaft 30 is secured to the rotor 25 through means of a key 133, the rotor 25 having two vanes 26 which are urged centrifugally radially outwardly as the rotor 25 rotates. It is also seen that the intermediate housing 4 has an axially disposed passage 134 for the passage of cooling water, and a substantially radial passage 135 for conducting an oil lubricant to the inside space 27.

In this embodiment, the drive shaft 30 is adapted to be driven by means of a suitable driving means, and the drive shaft 107 of the Siegbahn molecular pump D is driven through means of the speed change mechanism C which has substantially the same construction as that of the embodiment of FIG. 7, but which also acts as an increase gear mechanism, and this speed change mechanism C may be modified so as to have a construction of the belt type, as shown in the previous embodiment of FIG. 1. Furthermore, the rotary pump assembly may be modified so as to have an assembly of the two-stage compression type.

The operation of the embodiment illustrated in FIGS. 8 – 11 will now be explained. When the fluid from the exhausted system is in the molecular flow region and the drive shaft 30 of the Gaede rotary pump assembly B is driven at a rate approximating 2,000 R.P.M. by its suitable driving means, the drive shaft 107 of the Siegbahn molecular pump assembly D is arranged to be rotated at a rate of 6,000 R.P.M. or more. Therefore, the disk 103 mounted upon the drive shaft 107 is rotated so as to inhale the fluid from the inlet port 2 and to pump compressed fluid to the outlet port 6. More particularly, the fluid at the inlet port 2 is compressed and pumped out to the intermediate chambers 116 and 117 along the grooves 114 and 115 as the disk 103 rotates. During this operation, the labyrinth grooves 119*a*–119*d* serve to prevent any backward flow of fluid and also to pump out any backward fluid flow toward the intermediate chambers 116 and 117. Thus, the exhaust efficiency will be increased by means of the spiral grooves, including the labyrinth grooves.

The fluids pumped out to chambers 116 and 117 are then compressed and exhausted to the further chambers 130 and 131 along screw grooves 126 and 127 as a result of the rotation of cylindrical portion 104. The fluids within chambers 130 and 131 are then finally compressed and exhausted to the forepressure chamber 132 along screw grooves 128 and 129 upon the rotation of cylindrical portion 104, and the compressed fluids are thus pumped out to the outlet port 6 via the aperture 106.

The operation of the Gaede rotary pump assembly B is substantially the same as that of the previous embodiment, and therefore, a detailed explanation thereof is omitted herefrom. It is noted that the backward flow of fluid from the Gaede pump assembly B towards the Siegbahn pump assembly D is prevented due to the labyrinth seal effect and the pumping effect of the spiral grooves mentioned above, and in addition, the oil creeping toward the disk 103 due to the adherence thereof will be prevented because the disk 103 is coated with a fluoride resin of a non-adherent material. As a result, clean vacuum pressure will be obtained.

Also in this embodiment, a vacuum pressure of the $10^{-1}$ – $10^{-2}$ Torr level can be maintained within the forepressure chamber 132 due to the arrangements of the magnetic fluids 9 and 10 and of the bearings 11 and 12 at the atmospheric sides of the apparatus. If the rotary pump assembly is of the two-stage compression type, vacuum pressures of the $10^{-3}$ – $10^{-4}$ Torr level can be maintained.

During the above operation, the cooling hole 108 receives the cooling water through means of the nozzle 109 so that frictional heat at the magnetic fluids 9 and 10, and the compression heat at disk 103, may be reduced. The passage 134 also receives cooling water so as to thereby effect the cooling between the housing section 16 and the intermediate housing 4 and of the body 24. Thus, the operation of the Gaede rotary pump B at high rotational speeds may be assured so as to thereby obtain the ultimately high pressures.

In this embodiment, the compression work W can be written in the same manner as in the previous embodiment as follows:

$$W = \frac{K}{K-1} P_1 V_1 \left[ \left( \frac{P_2}{P_1} \right)^{\frac{K-1}{K}} - 1 \right] \quad (6)$$

wherein K is the ratio of the specific heat; $V_1$ is the volume of the fluid at the inlet port, $P_1$ is the inlet pressure of the fluid, and $P_2$ is the outlet pressure of the fluid. The depths of the screw and spiral grooves of the molecular pump assembly may be designed to be ten millimeters or more, and therefore, the molecular pump assembly commences operation after the backing pressure at the chamber 132 is increased to the $10^{-3}$ Torr level or more in view of the mean free-path of the fluid. In other words, the molecular pump assembly D will be idle under a backing pressure of the $10^{-2}$ Torr level or less so that no heat will be produced. During the operation of the molecular pump assembly D, the value of W is considerably less because of the high vacuum inlet pressure $P_1$ of the $10^{-3}$ Torr level or more, whereby a high exhaust efficiency will be achieved and heat will be considerably less.

The speed $S_o$ of the exhaust of the molecular pump assembly D may also be expressed as follows:

$$So = \frac{bhu}{2} \quad (7)$$

wherein $b$ is the width of the groove; $h$ is the depth of the groove, and $u$ is the angular velocity of the disk 103. In this embodiment, $b$, $h$ and $u$ in the above equation can be designed to be large, and a plurality of grooves can be provided. Thus a practical exhaust speed, which may correspond to 100 l/sec., can be achieved.

The exhaust characteristics of the rotary pump assembly can also be expressed as follows:

$$\frac{P_2}{P_1} = \frac{V_1}{V_2} \quad (8)$$

wherein $V_2$ is the volume of the fluid at the outlet port 6. A value of the $10^3$ level can be designed as the compression ratio $P_2/P_1$ of the pump, so that the ratio $V_1/V_2$ will also be of the $10^3$ level. This means that $V_2$ is substantially less than that of $V_1$, and if $P_2/P_1 = 1000$, the $V_2$ becomes $V_1/1000$. Therefore, $V_2$ may be 6 l/sec. if $V_2 = 6{,}000$ l/sec.

If the leakage of fluid through the clearance between the disk 103 and housing 1 is neglected from consideration, the maximum compression rate or ultimate pressure ($r_o$) of the molecular pump assembly is expressed as follows:

$$r_o = \exp\left(\frac{\theta}{h} LU\right) \quad (9)$$

wherein L is the length of the groove, and $\theta$ is the friction constant of the fluid. Therefore, a braking pressure of the $10^{-3}$ Torr level and an ultimate pressure of the $10^{-6}$ Torr level can be obtained as will be clearly appreciated from the discussion noted hereinbefore.

When the exhausted fluid is in viscous flow region, the molecular pump assembly D does not achieve compression and exhaustion, and thus, the rotary pump assembly B functions in substantially the same manner as in the previous embodiment so that a detailed explanation thereof is omitted herefrom.

Figure 12:
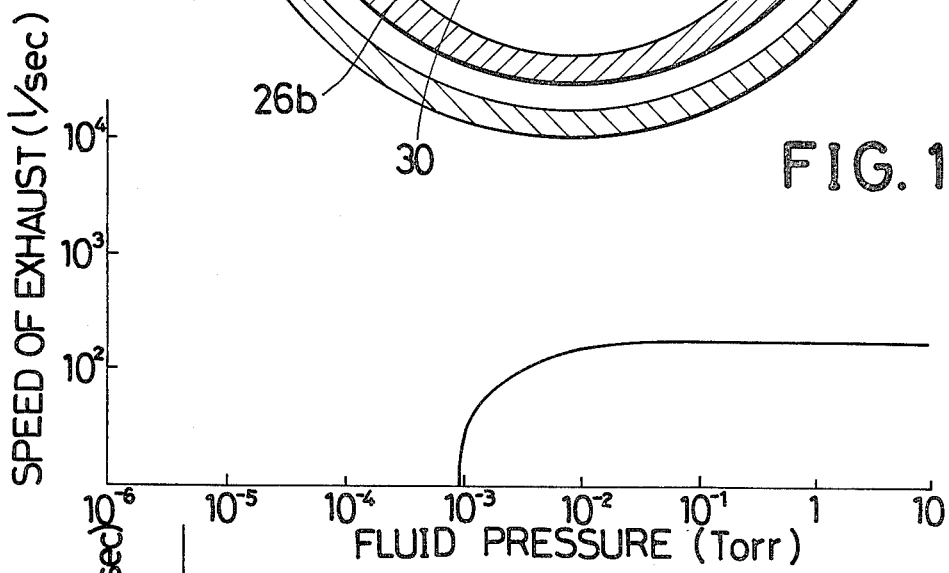
FIG. 12 is a graphical diagram showing the speed of exhaust of a conventional rotary pump assembly which corresponds to 200 l/sec, as a function of fluid pressure.
Figure 13:
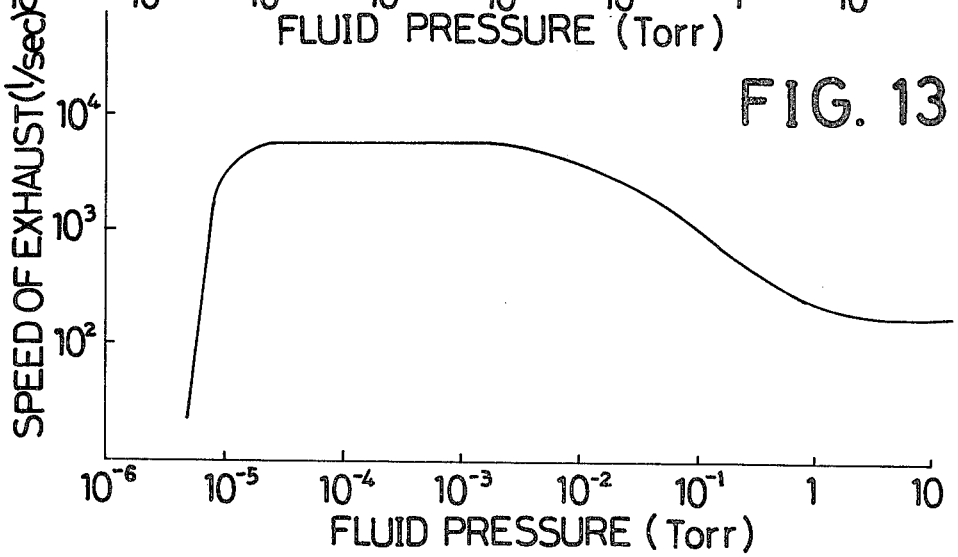
FIG. 13 is a graphical diagram showing the speed of exhaust of the high vacuum pump mechanism according to the present invention as a function of fluid pressure.

The exhaust speed of the high vacuum pump mechanism comprising the molecular pump assembly, having a designed exhaust speed of 6,000 l/sec., and the rotary pump assembly having a designed exhaust speed of 200 l/sec. according to the present invention is shown in FIG. 13. In the conventional rotary pump assembly having an exhaust speed of 200 l/sec, it is well known that the exhaust speed is suddenly decreased in the vacuum region of $10^{-1}$ Torr or more, as shown in FIG. 12. However, according to the construction of the present invention, as noted hereinabove, the molecular pump assembly acts as a mechanical booster for the rotary pump assembly so that the exhaust is considerably increased in the vacuum region of $10^{-1}$ or $10^{-2}$ Torr, as shown in FIG. 13.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A high vacuum pump mechanism comprising:

a molecular pump assembly including a housing having inlet and outlet ports, spiral groove means formed within the interior walls of said housing so as to thereby establish fluidic communication between said ports, said spiral groove means having main and subsidiary groove means, one end of said subsidiary groove means being closed from said inlet port and the other thereof being open to said outlet port, a circular disk interposed between said interior walls so as to face said walls with small clearances therebetween, a drive shaft carrying said disk thereon so as to thereby cause the latter to rotate so that a compression and pumping operation of the fluid is achieved along said spiral groove means from said inlet port to said outlet port, and a high vacuum seal mechanism for said drive shaft so as to thereby define a forepressure chamber which is in communication with said outlet port;

an oil-sealed rotary pump assembly including a body having inlet and outlet ports wherein said inlet port of said rotary pump is directly connected to said outlet port of said molecular pump assembly and said outlet port of said rotary pump is exposed atmospheric conditions, a rotor eccentrically arranged within a bore of said body so as to form variable volume chambers which connect to said inlet and outlet ports of said rotary pump, and a drive shaft carrying said rotor thereon so as to thereby cause the latter to rotate so that a compression and pumping operation of said fluid is achieved through said variable volume chambers from said inlet port to said outlet port of said rotary pump; and a speed reduction mechanism between said two drive shafts so as to impart a driving force to one of said drive shafts when the other one of said drive shafts is driven.

2. A high vacuum pump mechanism as set forth in claim 1, wherein:

said high vacuum seal mechanism comprises magnetic fluids for sealing said vacuum.

3. A high vacuum pump mechanism as set forth in claim 2, further comprising:

bearing means, for said drive shaft of said molecular pump assembly, which are disposed upon the atmospheric side of said magnetic fluids.

4. A high vacuum pump mechanism as set forth in claim 2, wherein:

the ultimate pressure of said rotary pump assembly is approximately $10^{-4}$ Torr and the ultimate pressure of said molecular pump assembly is approximately $10^{-6}$ Torr.

5. A high vacuum pump mechanism as set forth in claim 2, wherein:

each of said main and subsidiary groove means includes a plurality of spiral grooves.

6. A high vacuum pump mechanism as set forth in claim 2, wherein:

said circular disk has a cylindrical portion disposed within additional interior walls of said housing between said spiral groove means and said outlet port of said molecular pump, said additional interior walls having screw groove means such that a compression and pumping operation of fluid is achieved along said screw groove means between said spiral groove means and said outlet port of said molecular pump when said disk rotates.

7. A high vacuum pump mechanism as set forth in claim 6, wherein:

each of said main and subsidiary groove means includes a plurality of spiral grooves.

8. A high vacuum pump mechanism as set forth in claim 2, wherein:

said drive shaft of said molecular pump assembly has a cooling hole means for receiving cooling water.

* * * * *